United States Patent [19]

Polonyi

[11] 3,949,990

[45] Apr. 13, 1976

[54] ROTATING DISK TOY

[76] Inventor: Joseph Polonyi, P.O. Box 182, Forest Hills, N.Y. 11375

[22] Filed: July 11, 1974

[21] Appl. No.: 487,616

[52] U.S. Cl. ..... 273/118 A; 46/43; 273/127 R; 273/127 D

[51] Int. Cl.[2] ..... A63F 7/00

[58] Field of Search ..... 273/105.2, 108, 111, 117, 273/118 R, 118 A, 118 D, 119 R, 119 A, 119 B, 120 R, 120 A, 122 R, 122 A, 123 R, 123 A, 125 R, 125 A, 127 R, 127 A, 127 B, 127 C, 127 D, 176 B; 46/1 K, 43; 35/43

[56] References Cited

UNITED STATES PATENTS

| | | | |
|---|---|---|---|
| 1,481,786 | 1/1924 | Barber | 273/125 R |
| 1,538,449 | 5/1925 | Schulz | 273/120 A |
| 1,567,251 | 12/1925 | Ekstein | 273/120 R |
| 3,430,959 | 3/1969 | Ross et al. | 273/127 D |
| 3,643,949 | 2/1972 | Habash | 273/101 |
| 3,686,789 | 8/1972 | Polonyi | 46/43 |
| 3,713,654 | 1/1973 | Goldfarb | 273/108 |
| 3,826,496 | 7/1974 | Summa | 273/108 |

OTHER PUBLICATIONS

"Windmill", Golf Supplies, Par Golf Mfg. Co., Milan, Illinois, Apr., 1964, p. 19.

*Primary Examiner*—Richard C. Pinkham
*Assistant Examiner*—R. T. Stouffer
*Attorney, Agent, or Firm*—Kenyon & Kenyon Reilly Carr & Chapin

[57] ABSTRACT

A game for simulating launching and landing of spacecraft. An elongated channel attached to an upright stand defines a predetermined path for a moving game piece. A notched rotating disk mounted on the stand transversely above the channel prevents passage of the game piece except when the notch coincides with the channel. The effective circumferential extent of the notch can be selectively varied by a movable shutter for simulating approach corridors of varying widths. Alternatively, a target plaque pivotally mounted in the notch rotates from a first to a second position if struck by a simulated missile. Game pieces that fail to pass the rotating disk are prevented from bouncing back into the approach channel by a one-way barrier and are then removed from the channel by flanges protruding from the face of the disk. The disk may be rotated with constant angular velocity or with continuously varying velocity by means of off-center gears.

12 Claims, 10 Drawing Figures

ROTATING DISK TOY

BACKGROUND OF THE INVENTION

1. Field of the Invention

The present invention relates to a game that involves directing an object at a moving target and particularly to a game in which a moving object is guided along a predetermined path that is alternately blocked and opened by a moving barrier.

2. Description of the Prior Art

Representative examples of games in which rolling balls or other moving game pieces are directed at moving targets, pockets or entryways are provided in U.S. Pat. No. 1,481,786 issued Jan. 29, 1924 to G. T. Barber, U.S. Pat. No. 1,538,449 issued May 19, 1925 to F. Schulz, and U.S. Pat. Nos. 1,567,251 and 1,656,272 issued Dec. 29, 1925 and Jan. 17, 1928, respectively, to J. Ekstein.

The U.S. Pat. No. 1,481,786 to Barber shows a game having upwardly inclined parallel alleys that are substantially tangent to the upper surface of a drum rotating about a horizontal axis. The alleys are interrupted by an arcuate portion of the drum, which has a number of spaced holes at axially spaced locations aligned with the center of each alley. The object of the game is to roll a ball up one of the inclined alleys so that it arrives at the top coincidentally with a corresponding hole in the drum. If its velocity is not too great, the ball will then drop through the hole into the drum and return to the player via a discharge chute and return alley. If the player misses one of the holes in the drum or the velocity is too great, the ball continues in its path over the top of the drum to the end of the alley, where it drops into a vertical chute connecting with the return alley.

In the game apparatus of Schulz U.S. Pat. No. 1,538,449 a ball is rolled down an inclined board having side rails that converge to a discharge passageway. A horizontal disk is mounted for rotation about a vertical axis, the edge of the disk being adjacent to the discharge passageway. The disk has spaced openings cut out of its edge, and the object of the game is to drop the ball through one of these openings when the opening is aligned with the discharge passageway from the board. The ball will then drop through a vertical chute and strike a trigger to actuate a mechanism for delivering a prize to the player. If the ball passes through the discharge passageway when a disk opening is not so aligned or at too great a velocity, the ball will pass radially across the disk into a central well.

In the earlier Ekstein U.S. Pat. No. 1,567,251, a motor-driven vertical shaft carries a spider that supports radial channels for rotation past the end of a chute. The object of the game is to roll a ball down the chute so that it arrives at the end coincidentally with one of the radial channels. If the player is successful, the ball will enter the radial channel and be deposited in a center cup; otherwise the ball will strike a baffle and be deflected into a return chute leading to a receptacle for returned balls. In an alternative embodiment, the successful shot passes from the radial channel into a vertical tube leading downward from the inner end of the channel and thence through an arcuate slot in a support base for the rotating structure to another chute leading to the receptacle for returned balls.

The second Ekstein U.S. Pat. No. 1,656,272 discloses improvements to the earlier game apparatus. These improvements include substitution of closed pockets for the radial channels and provision for oscillatory vertical motion of the outer ends of the pocket structures superimposed on their horizontal rotation. In an alternative embodiment, a vertical disk is mounted for rotation on a horizontal shaft, with the plane of the disk parallel to the direction of a discharge chute. A number of angularly spaced pockets are mounted on the disk for successive alignment with the end of the chute as the disk rotates.

In the foregoing prior art games the moving ball changes either speed or direction as the result of a successful encounter with a moving entryway or pocket. In some of them, such as the Schulz and Barber games, successful interception requires not only proper timing but also that ball velocity be below some maximum value. In none of them is the size of the entry or pocket adjustable to adapt the game to players having varying degrees of skill.

SUMMARY OF THE INVENTION

The apparatus of the present invention provides a rotating go-no go barrier for a game or toy in which a rolling ball or other moving game piece is directed in a predetermined linear path by an elongated guideway. Although adaptable to many game situations, the present invention is intended primarily to increase the educational and game value of the modular space toy disclosed in my prior U.S. Pat. No. 3,686,789, issued on Aug. 29, 1972, by adding launch or encounter window simulation to the interplanetary space travel game described in that patent.

Accordingly, it is an object of the present invention to provide a game apparatus in which a moving barrier alternately blocks and unblocks a guideway for a moving game piece.

It is another object of the invention to provide a game apparatus having a rotating barrier with an opening of selectively adjustable size for alternately preventing and permitting passage of a moving game piece along a predetermined path, the relative duration of the passage preventing and permitting periods being determined by the selected size of the opening.

Another object of the invention is to provide a pivoting target mounted in an opening of a rotating transverse barrier positioned across a guideway such that passage through the opening of a game piece moving along the guideway will cause the target to pivot from a first predetermined position to a second predetermined position.

It is still another object of the invention to provide a motor drive train for a rotating barrier to produce a constantly varying speed of rotation.

These and other objects are accomplished by a game apparatus that includes an upright stand; a guideway attached to the stand for guiding a moving game piece along a predetermined path; a movable barrier in the form of a disk having a portion cut out from its circumference; means for mounting the disk on the stand directly above the guideway for rotation about the center of the disk in a plane transverse to the direction of the predetermined path such that passage of a moving game piece along the predetermined path is prevented by the disk except when the cut out portion is aligned with the guideway.

The disk preferably is equipped with a movable shutter for selectively varying the circumferential extent of the cut out portion to vary correspondingly the relative times that the guideway is blocked and unblocked during each revolution of the disk.

The disk also preferably includes a target plaque pivotally mounted in a cut out portion of the circumference for rotation from a first position in which one face of the target plaque is presented to a game player to a second position in which the reverse face of the target plaque is presented to the player.

To prevent a game piece that did not pass the barrier from bouncing back and obstructing the guideway, the game apparatus preferably also includes a one-way barrier in front of the disk that may comprise simply a step down in the guideway, with the riser of the step serving as a barrier to trap the game piece between the riser and the face of the disk. Protrusions, such as radial flanges extending from the face of the disk, then sweep the trapped piece laterally from the guideway to clear the path for the next game piece.

Means for rotating the disk may include a handcrank or preferably an electric motor driving through gear trains to provide either constant speed rotation or, optionally, continuously variable rotation speeds.

These and other features and objects of the invention will be apparent from the following description of preferred embodiments in conjunction with the accompanying drawings.

DESCRIPTION OF THE PREFERRED EMBODIMENTS

Figure 1:
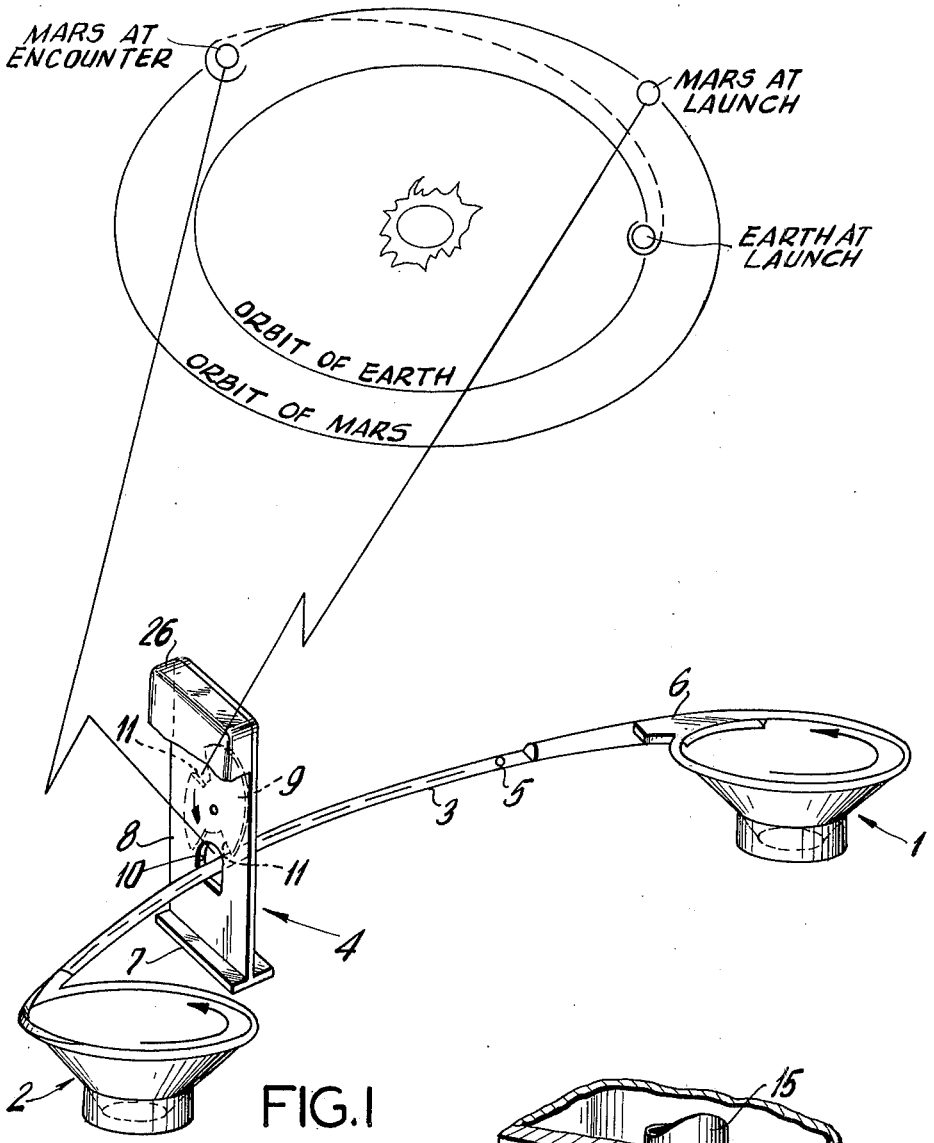
FIG. 1 is a rear perspective view of a rotating disk toy according to the invention as adapted to simulate an encounter window in combination with a modular space toy.

Reference has been made earlier to the particular applicability of the rotating barrier game apparatus of the present invention to simulate a launch or encounter window for interplanetary spaceship travel in conjunction with the modular space toy described in my prior U.S. Pat. No. 3,686,789. An arrangement for demonstrating such a simulation is illustrated by FIG. 1, in which conical bowls 1 and 2 and interconnecting guideway 3 are components of my prior modular space toy. The rotating disk toy of the present invention is designated generally by reference numeral 4.

In the game arrangement of FIG. 1, bowl 1 simulates a launching system for a spaceship, represented by moving ball 5. The flat bottom of bowl 1 represents a planet, such as Earth, and the ball is set to rotating counterclockwise around the inside of the bowl until it reaches "escape" velocity and enters tangential passageway 6 at the top of the bowl. From passageway 6, the ball enters interconnecting guideway 3 and travels toward the second bowl 2, representing Mars as shown in the diagram.

In order for a spaceship from Earth to enter landing orbit around Mars, it must lead the target because of the relative movement between Mars and Earth from the time of launch to the time of encounter. Rotating disk toy 4 provides the simulation for this maneuver.

Toy 4 includes an upright stand having a base 7 supporting a vertical panel 8. Panel 8 faces bowl 1 and has a cut out opening 10 for guideway 3 to pass through the panel. Above the guideway is a movable barrier such as flat circular disk 9 mounted on the panel for rotation about an axis through the center of the disk, the axis being located above the guideway by a distance such that the edge of the disk clears the guideway but prevents passage of ball 5 through the opening in the panel.

Disk 9 has a notch 11 extending for a predetermined circumferential extent in the edge of the disk. Notch 11 simulates the "encounter window" or "entry corridor" for the planet Mars in the illustrated embodiment of the game. As shown in FIG. 1, notch 11 must coincide with panel opening 10 to permit passage of ball 5 into "orbit" around Mars, as defined by the walls of bowl 2, with Mars at the base of the bowl. Assuming clockwise rotation of disk 9, as shown by the arrow, it is clear that the position of notch 11 must be at some point ahead of opening 10 at the time that the ball is "launched" from bowl 1. In the diagram, for example, notch 11 is approximately at the 2 o'clock position at the time of launch. The notch then rotates to the 6 o'clock position in the time that it takes ball 5 to travel along guideway 3 to the rotating disk. Thus, the combination of the rotating disk apparatus with the modular space toy of my prior U.S. Pat. No. 3,686,789 contributes substantially to increased educational value as well as enjoyment of the interplanetary space travel game.

The details and additional features of the preferred embodiment of the rotating disk apparatus are shown more clearly in FIGS. 2 through 5. As shown in these figures, disk 9 is attached to a shaft 12 that is journalled for rotation in panel 8. The forward end of shaft 12 is threaded for a nut 13, and the rear end of the shaft carries a drive gear 14. An electric motor 15 turns the disk through a pinion 16, a ring gear 17, a secondary shaft 18, and a second pinion 19 that engages the drive gear 14. Motor 15 is powered by batteries 20 installed on the rear of base 7 and connected to the motor through wires 21, 22 and a switch 23 that is located at any convenient position.

Figure 3:
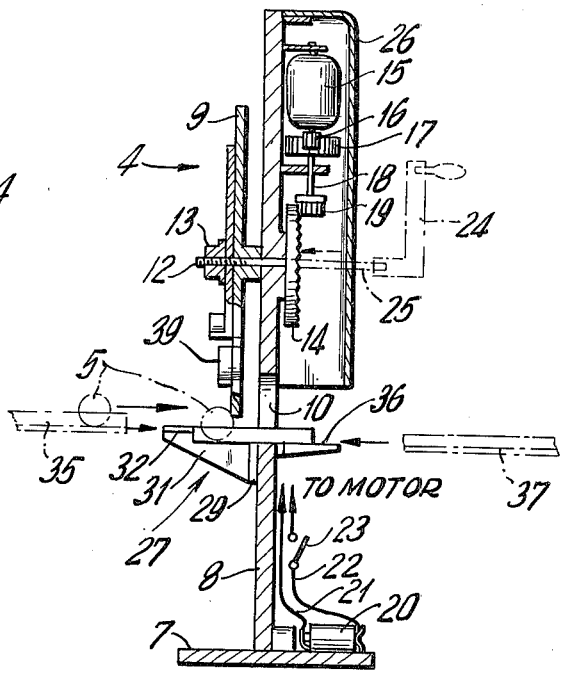
FIG. 3 is a section view of the rotating disk toy of FIG. 2 taken along line 3—3.

As an alternative to the electric motor drive, the disk can be driven by a simple handcrank 24 attached to an extension 25 of shaft 12 (see FIG. 3). To protect the fingers of children, the drive mechanism is surrounded by a cover 26.

Figure 4:
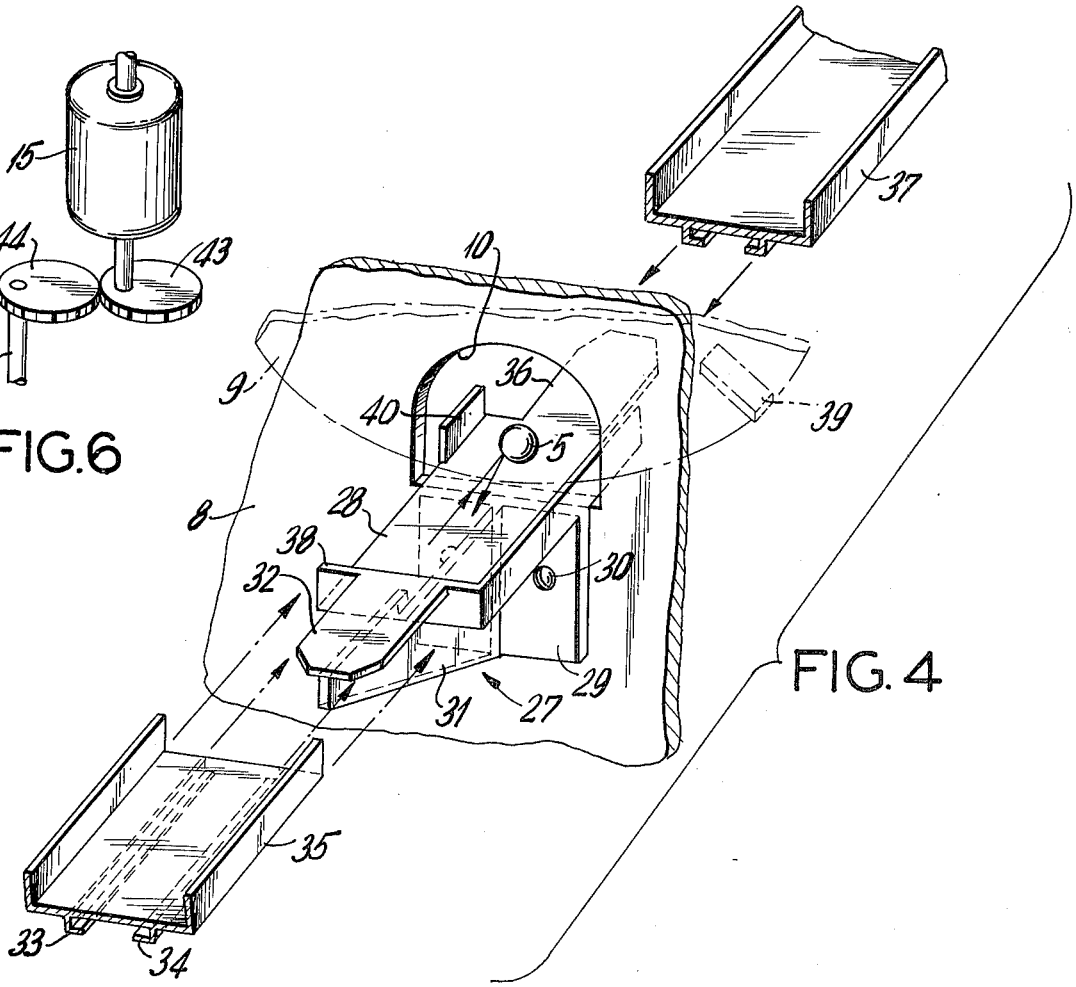
FIG. 4 is an enlarged perspective view of a guideway attachment support for the rotating disk toy of FIG. 2.

Referring to FIG. 4, there is shown a preferred arrangement for attaching the guideway to either side of the panel. This arrangement comprises a guideway bracket 27, preferably made of molded plastic. The bracket is in the form of a horizontal guideway portion 28 with a dependent transverse flange 29 for attachment to panel 8 by means of screws 30. A longitudinal triangular gusset 31 provides a rigid connection between the bottom of guideway 28 and flange 29 and also supports a horizontal tongue 32 extending forward for frictional engagement with a mating groove formed by angle members 33 and 34 molded in the underside of a plastic channel member 35 that defines the travel path for ball 5 from bowl 1. A similar tongue 36 extends from the rear of guideway bracket 27 for frictional engagement with mating channel member 37 that continues the ball pathway to bowl 2.

An important feature of guideway bracket 27 is the provision of a one-way barrier to prevent bounce back of ball 5 into channel section 35 in the event that the ball fails to successfully pass through the notch in the rotating disk. This one-way barrier consists of a transverse riser 38 extending above the floor of guideway 28 at the forward end, with tongue 32 leading into the top of the riser. Thus, if the player miscalculates the necessary lead required in launching ball 5, the ball will enter guideway 28 when the notch of disk 9 is not aligned with the guideway. The ball will then strike the face of the disk and will reflect backward and downward into contact with riser 38, as indicated by the arrows.

In order to remove a ball trapped by barrier riser 38 from the guideway, rotary disk 9 carries at least one protrusion, in the form of a short radial flange 39, extending from its face adjacent to the edge of the disk. A portion of the left hand wall 40 of guideway 28 is removed so that as the radial disk rotates in the clockwise direction, flange 39 swings down and knocks the ball off the guideway so that it will not interfere with the next simulated spaceship to be launched.

Figure 5:
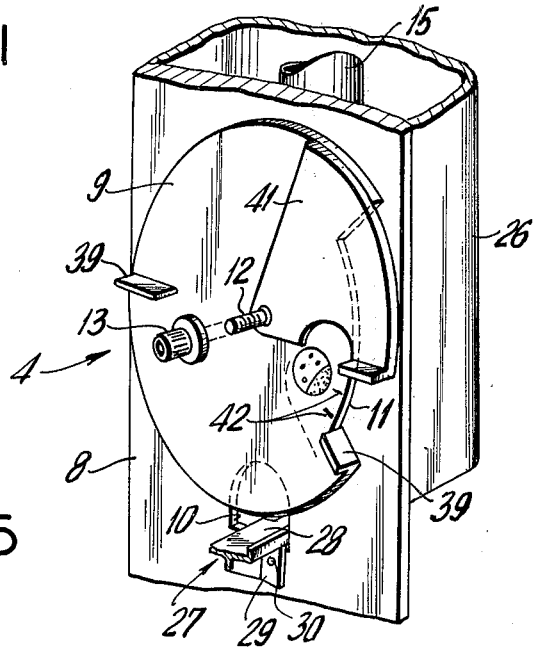
FIG. 5 is a partial front perspective view of the rotating disk toy of FIG. 2 illustrating the manner of mounting a sector plate shutter on the disk.
Figure 2:
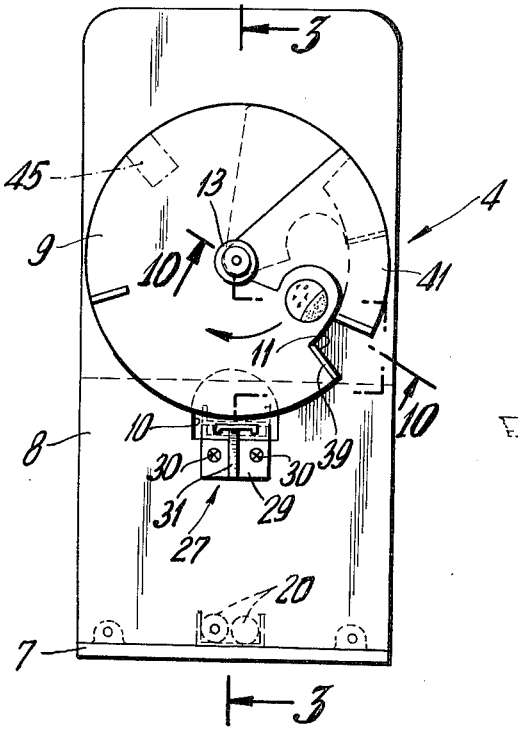
FIG. 2 is a front view of the rotating disk toy of FIG. 1.

Referring next to FIG. 5, a feature of the preferred disk embodiment is shown as a movable shutter in the form of a sector plate 41 having a radius equal to the radius of the disk. The shutter plate is pivotally mounted on shaft 12 in overlapping relation against the disk, with nut 13 holding the shutter in frictional engagement with the disk. Rotation of the shutter with respect to the disk against the frictional force permits adjustment of the effective circumferential extent of notch 11 by preselected increments, as measured by graduations 42.

Adjustment of sector plate 41 to uncover the complete extent of notch 11 (which is shown as approximately 90° in the illustrated embodiment) adapts the game for use by even very young children and simulates travel to a planet having a very wide entry corridor. On the other hand, adjusting the shutter to a narrow opening for the notch provides a challenge to even an adult player. In this way, the game can be adapted to be played by a number of persons of widely varying age and skills.

Figure 6:
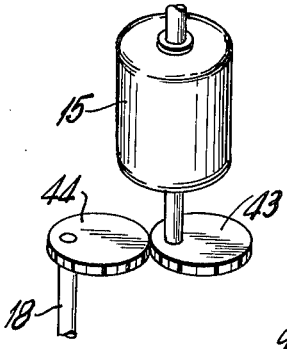
FIG. 6 is a perspective view of an alternate drive train for the motor drive shown in FIG. 3.

The drive train illustrated in FIG. 3 provides a constant angular velocity of the disk, preferably about 10–16 rpm. FIG. 6 illustrates an alternative embodiment in which a pair of meshing off-center gears 43 and 44 replace gears 16 and 17 in FIG. 3. As is well known, a pair of such off-center gears will provide a continuously varying output speed to shaft 18 from a constant input speed as delivered by the motor. Such continuously varying rotation speed more closely simulates the velocity of planets in an elliptical orbit and increases the challenge to the player's skill in properly choosing the ball release time.

Figure 9:
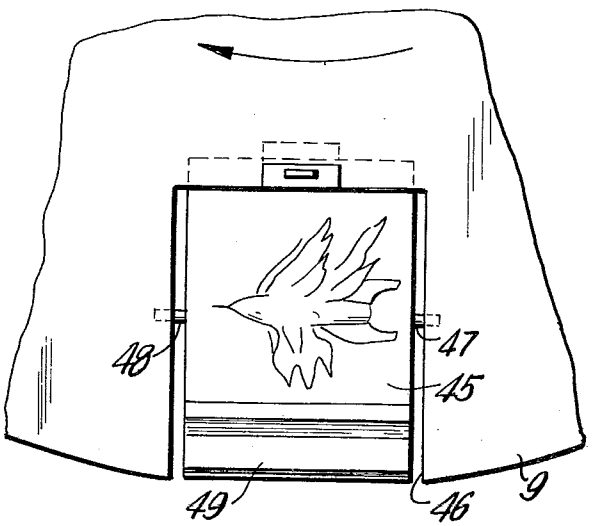
FIG. 9 is a partial front view similar to FIG. 8 but showing the target plaque in a second predetermined position.
Figure 8:
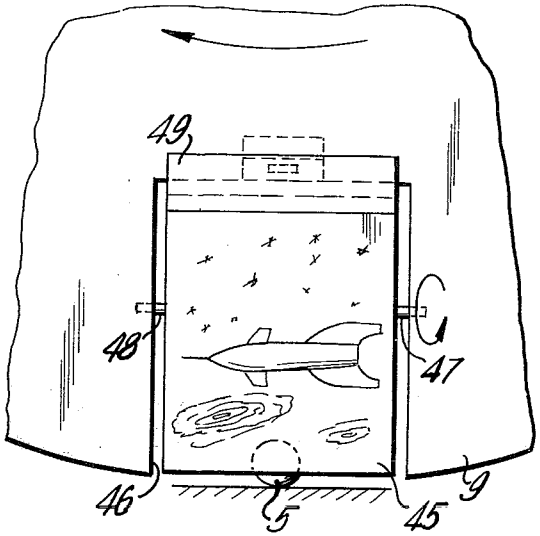
FIG. 8 is a partial front view of the rotating disk of FIG. 7 showing the target plaque in a first predetermined position.
Figure 7:
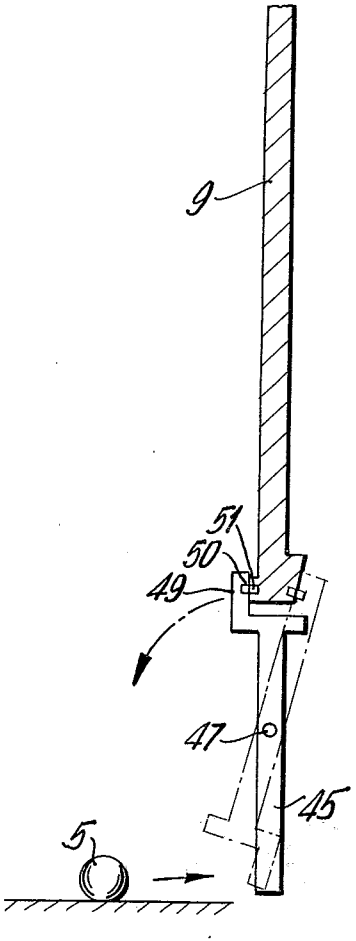
FIG. 7 is a radial section view of a pivoting target plaque mounted in a cut out portion of the rotating disk of FIG. 2.

Referring next to FIGS. 7–9, disk 9 can optionally be fitted with a target plaque 45 pivotally mounted in a notch 46 in the edge of the disk on axles 47 nad 48. The axis of axles 47, 48 intersects the sides of notch 46 at approximately their midpoints to permit the target plaque to flip from a first position in which one face of the plaque is exposed (FIG. 8) to a second position in which the reverse face is exposed (FIG. 9).

The target plaque is held in the first position by an offset lip 49 which abuts the inner edge of the notch and carries a piece of iron 50 for mating contact with a magnet 51 embedded in the disk. When the outer edge of the target is struck by a ball 5 with sufficient impact to disengage the piece of iron from the magnet, the target will flip to the second position shown by broken lines in FIG. 7. The target is held in the second position by a similar magnetic catch until it is reset by the player.

The exposed face of the target plaque in the first position may carry an illustration of an "enemy" space ship, as shown in FIG. 8, to increase the excitement of the game. When a hit is scored, the target plaque flips to reveal the enemy spaceship in flames (FIG. 9).

The optional target embodiment may be used in place of or, preferably, in addition to the notch and shutter combination. In the latter case the target notch can be spaced circumferentially from the "encounter window" notch.

Figure 10:
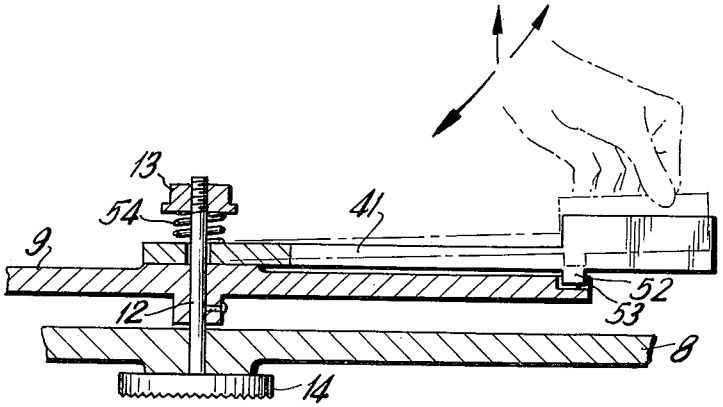
FIG. 10 is a partial section view showing an alternate mounting arrangement for the sector plate shutter of FIG. 5.

FIG. 10 shows an alternative arrangement for permitting selective positive adjustment of the sector plate shutter 41 without loosening and retightening nut 13. In this arrangement, the back of the sector plate has a protrusion 52 that can selectively engage any one of a plurality of mating angularly spaced indentations 53 in the face of disk 9. A coil spring 54 positioned between the nut and the face of the sector plate allows the edge of the plate to be lifted so that protrusion 52 is clear of indentation 53, and the shutter can be rotated to another selected angular position without disturbing the nut on the shaft.

Although the preferred embodiments of the rotating disk toy of the present invention have been illustrated and described, it will be apparent that many variations in constructional details can be employed without departing from the scope of the invention.

Furthermore, although the present invention has been demonstrated as being particularly suitable for use in an interplanetary space travel game in conjunction with the modular space toy of my U.S. Pat. No. 3,686,789, it will also be apparent that is has broad application in any type of game in which a gamepiece is projected or propelled along a guideway in a predetermined path.

I claim:

1. A game comprising an upright stand; a guideway attached to the stand; a game piece which is guided along a predetermined linear path when moving on said guideway; a circular disc having a notch in the edge of the disk, the circumferential extent of the notch being greater than the width of the moving game piece; means for mounting the disk on the stand for rotation about its center in a plane transverse to the predetermined path at a location such that the edge of the disk prevents passage of the game piece along the path except when the notch coincides with the path of the game piece; means for rotating the disk about its center to periodically permit passage of the game piece through the notch opening; a shutter for covering a portion of the notch; and means for movably mounting the shutter on the disk to allow selective variation of the effective circumferential extent of the notch available for permitting passage of the moving game piece along the predetermined path.

2. A game according to claim 1 wherein the shutter comprises a sector plate having a radius equal to the radius of the disk; and the shutter mounting means comprises a threaded shaft attached to the center of the disk, the shutter being rotatably mounted on the shaft, and a nut threaded on the shaft for holding the shutter in overlapping relation against the disk.

3. A game according to claim 2 further comprising a protrusion on one of the shutter and disk and a plurality of mating angularly spaced indentations on the other of the shutter and disk to permit engagement of the protrusion and a selected one of the indentations to hold the shutter in any of a plurality of graduated angular positions relative to the disk for covering a selected circumferential portion of the notch.

4. A game according to claim 3 further comprising a spring between the nut and the sector plate for urging the sector plate into contact with the disk yet for permitting the sector plate to be disengaged from the disk to rotate the sector plate with respect to the disk to a different relative angular position.

5. A game comprising a flat panel having a cut out opening therethrough; means for supporting the panel in an upright position; an elongated guideway attached to the panel for conducting a moving game piece through the opening along a predetermined path transverse to the panel; a circular disk having a notch in a portion of the edge of the disk; means for mounting the disk on the panel for rotation about the center of the disk, the axis of rotation being located with respect to the opening in the panel such that the disk prevents passage of the moving game piece through the opening except when the notch coincides with the path of the game piece; means for rotating the disk about said axis to periodically permit passage of the game piece through the notch; and a target plaque mounted in the notch for pivotal movement when struck by a game piece moving along the predetermined path.

6. A game according to claim 5 wherein the target plaque is mounted for pivoting motion from a first position presenting one face to the moving game piece to a second position presenting the reverse face of the plaque to the game piece.

7. A game according to claim 5 wherein the target plaque is mounted in the notch for pivotal movement about an axis intersecting the sides of the notch at approximately their midpoints between a first position presenting one face of the plaque to the moving game piece and a second position presenting the reverse face of the plaque to the game piece.

8. A game according to claim 7 comprising means for releasably holding the target plaque in first position, said holding means releasing the plaque for rotation to the second position when the plaque is struck by a moving game piece having at least a predetermined minimum momentum.

9. A game comprising an upright stand; a channel supported by the stand; a ball which is guided along a predetermined path by said channel when moving thereon; a disk having a portion cut out from the circumference thereof, the circumferential extent of the cut out portion being larger than the diameter of the moving ball but smaller than the uninterrupted extent of the disk circumference; means for mounting the disk on the stand for rotation about its center in a plane transverse to the predetermined path, the disk being positioned above the channel such that the edge of the disk clears the surface of the channel but blocks passage of the moving ball except when the cut out portion is alined with the channel; and means for rotating the disk, whereby passage of the moving ball along the channel is alternately prevented by the disk edge and permitted by the cut out portion as the disk revolves.

10. A game comprising an upright stand; a channel supported by the stand; a ball which is guided along a predetermined path by said channel when moving thereon; a disk having a portion cut out from the circumference thereof, the dimensions of the cut out portion being larger than the diameter of the moving ball; means for mounting the disk on the stand for rotation about its center in a plane transverse to the predetermined path, the disk being positioned above the channel such that the edge of the disk clears the surface of the channel but blocks passage of the moving ball except when the cut out portion is aligned with the channel; means for rotating the disk, whereby passage of the moving ball along the channel is alternately prevented by the disk edge and permitted by the cut out portion as the disk revolves; and a one-way barrier located in front of the rotating disk in the path of the moving ball for preventing a ball that has failed to pass through the cut out portion from returning backward along the channel.

11. A game according to claim 10 further comprising a protrusion from the front of the disk near the edge for contacting any ball trapped between the one-way barrier and the disk and sweeping the contacted ball laterally from the channel as the disk rotates.

12. A game according to claim 9 wherein the means for rotating the disk comprises means for driving the disk at continuously varying angular velocity.

* * * * *